United States Patent [19]

Johnson

[11] Patent Number: 4,871,087

[45] Date of Patent: Oct. 3, 1989

[54] REUSABLE CONTAINER DISPENSER FOR ULTRA HIGH PURITY CHEMICALS AND METHOD OF STORAGE

[76] Inventor: David S. Johnson, R.D. #1 Box 104A, Howard, Pa. 16841

[21] Appl. No.: 176,873

[22] Filed: Apr. 4, 1988

[51] Int. Cl.[4] ..... B67D 5/00

[52] U.S. Cl. ..... 222/1; 222/152; 222/146.2; 220/426

[58] Field of Search ..... 220/426, 5, 425; 222/152, 1, 146.2, 335, 399; 261/121.1, 126; 239/373

[56] References Cited

U.S. PATENT DOCUMENTS

| | | | |
|---|---|---|---|
| 1,767,680 | 6/1930 | Hutt | 220/426 X |
| 2,970,042 | 1/1961 | Laserwey | 220/426 X |
| 3,110,157 | 11/1963 | Radd | 220/426 X |
| 3,135,420 | 6/1964 | Farell et al. | 220/426 |
| 3,272,373 | 9/1966 | Alleaume et al. | 220/426 |
| 3,764,035 | 10/1973 | Silverman | 220/426 |
| 3,919,855 | 11/1975 | Turner | 220/436 X |
| 3,924,773 | 12/1975 | Wilkinson | 220/426 X |
| 4,140,735 | 2/1979 | Schumacher | 261/22 |
| 4,343,413 | 8/1982 | Chatzipetros et al. | 220/425 |
| 4,459,793 | 7/1984 | Zenger | 220/426 X |
| 4,595,112 | 6/1986 | Dubois | 220/5 |
| 4,595,113 | 6/1986 | Fafflok et al. | 220/23 |

FOREIGN PATENT DOCUMENTS

| | | | |
|---|---|---|---|
| 143219 | 12/1920 | United Kingdom | 220/426 |

OTHER PUBLICATIONS

Diaphragm Breakseal Bubbler, Newsletter No. 23, Rev. 1, J. C. Schumacher Co.

Which Bubbler Do You Want in Your Wafer Fab Area? J. C. Schumacher Co. Newsletter No. 27.

Permeability of Teflon Bubblers, Newsletter No. 13, J. C. Schumacher Co.

Electronic Chemical News, 8/17/87, p. 6.

*Primary Examiner*—Andres Kashnikow
*Assistant Examiner*—Kevin P. Weldon
*Attorney, Agent, or Firm*—Steele, Gould & Fried

[57] ABSTRACT

In one embodiment, the container/dispenser for an ultra high purity chemical includes a thin walled inner container made of TEFLON polymer. The thin walled inner container is closed at the top by an inner container lid. An outer container surrounds the inner container and comprises a metal outer wall that is interiorly covered or lined with TEFLON polymer or other polymeric material. The outer container is closed at the top by an outer container lid. The inner container is separated from the outer container by a spacer assembly that spaces the side and bottom walls of the inner thin walled container away from the inteiror surface of the outer container. An inert gas is disposed in the interspace between the inner and outer container and a set of valves are mounted on the inner and outer container lids. One valve allows an inert gas to be bubbled through the ultra high purity chemical while another valve dispenses the "bubbled" chemical. Third and fourth valves permit injection and extraction of the inert gas from the interspace between the inner and outer containers. The method of storing and dispensing includes the steps of containing the ultra high purity chemical in a thin walled TEFLON polymer inner container, surrounding the entirety of the inner container with an inert gas, providing an outer container and enclosing the inner gas and the surrounding inert gas with the outer container.

20 Claims, 3 Drawing Sheets

REUSABLE CONTAINER DISPENSER FOR ULTRA HIGH PURITY CHEMICALS AND METHOD OF STORAGE

BACKGROUND OF THE INVENTION

The present invention relates to a reusable container that also is a dispensing system for containing, storing and dispensing ultra high purity chemicals.

The storage of ultra high purity liquid chemicals, for example those chemicals having a purity greater than or equal to 99.9999%, is difficult to achieve because vapors and gases from the environment and ions from the storage container itself diffuse into the highly pure chemical. Ultra high purity chemicals are customarily used in the manufacture of semiconductor or integrated circuit chips during a chemical vapor deposition step. Maintenance of the chemical purity during storage, transport and dispensing is critical to the ultimate quality of the finished semiconductor or integrated circuit product. To maintain this purity, a chemical resistant container is required which is impervious to the diffusion of contaminants such as water vapor, oxygen and other vapors and gases. In addition, to minimize exposure to humans during the dispensing process, the container should also include a dispensing apparatus.

Known containers/dispensers for high purity chemicals typically utilize a quartz glass container to maintain the chemical purity during storage and dispensing. However, the use of quartz glass complicates transportation, storage, usage and re-use of the containers.

Quartz glass containers are subject to breakage, leakage and general damage due to the fragile nature of the glass. Breakage may occur at any time and can result in severe injury or death to humans due to chemical exposure by the ultra high purity chemical or contaminate the environment. Further, due to their cost, these quartz glass devices are rebuilt and re-used several times which increases the probability of breakage of the glass due to weakening of the glass container during transportation, handling and reuse.

These quartz glass containers must be retired from service when sophisticated inspection techniques determine that the glass has been damaged, such as by etching or scratching, in order to prevent a complete failure of the glass container. This retirement may occur before the first re-use depending upon how carefully the container was handled during the transport, dispensing, re-transport and refilling operations. Premature retirement results in excessive cost to the vendor and to the ultimate user of the ultra high purity chemical. Due to a high degree of uncertainty and the potential of abuse during handling and transport operations, the inspection of used containers is costly since each container must be approved or recertified before continued service. Vendors and users cannot always be certain of the operating costs and business risks associated with these known devices and, therefore, they may require mandatory retirement at a prescribed time in the life of the quartz glass containers.

One commercially available container/dispenser is called a bubbler since the ultra high purity chemical is dispensed by injecting an inert or non-reactive gas, such as nitrogen, into a liquid phase pure chemical. This inert gas is injected at a lower region in the liquid filled container such that the inert gas bubbles to the surface of the liquid and becomes saturated with the high purity chemical. The level of saturation is based upon the pressure and temperature of the liquid and the ability of the inert gas to "carry" the high purity vapor molecules with it during the bubbling or dispensing process. One commercially available bubbler is manufactured by J. C. Schumacher Co. of Oceanside, Calif. Another bubbler is described in U.S. Pat. No. 4,140,735 to Schumacher. Some of the background details regarding the bubbling of high purity chemicals can be found in that Schumacher patent. Therefore, the Schumacher patent is incorporated herein by reference thereto. Typical high purity chemicals used in the manufacture of semiconductor products are phosphorus oxychloride, boron tribromide, trichloroethane, and others.

U.S. Pat. No. 4,343,413 to Chatzipetros et al. discloses a double walled vessel for dewar flasks wherein an inner glass container is spaced from an outer glass container by rubber-like spacers. U.S. Pat. No. 4,595,112 to Dubois discloses a thermal container having an outer walled container of metal, a thick walled insulating shell and a very thin walled plastic liner. The outer container, thick walled insulating shell and inner liner abut each other, that is, they are not spaced apart but are sandwiched together. U.S. Pat. No. 4,595,113 to Fafflok et al. discloses a container/dispenser having an outer housing made of plastic, a secondary double walled intermediate container of glass, plastic or similar material and an inner container. The inner container, double walled intermediate container, and outer container are all spaced apart and are maintained in a spaced relationship due to upper lips coacting together.

A study has analyzed the possibility of using "TEFLON" like material for containing ultra high purity chemicals. This study measured the permeability of TEFLON perfluoroalkoxy (PFA) polymer. The results of this study by J. C. Schumacher Co. indicate that the TEFLON polymer is permeable by water vapor. Based on this published study, it was thought TEFLON polymer would not be suitable for storing and maintaining the integrity of high purity chemicals. Very recently, Nalge of Rochester, N.Y. announced a new container for storing reactive and high purity chemicals made of teflon PFA. The TEFLON fluoropolymer's resistance was stated as being ideal for fluorine-fluoride chemistry.

OBJECTS OF THE INVENTION

It is an object of the present invention to provide a container/dispenser that utilizes spaced apart, TEFLON polymer or fluorocarbon inner containment walls.

It is a further object of the present invention to provide a container/dispenser that is contamination proof and prevents leaching of ions, water vapor and oxygen from the outer containment wall into the ultra high purity chemical.

It is a further object of the present invention to provide a container/dispenser that is safer to use, transport and re-use as compared with prior art container/dispensers for ultra high pure chemicals.

It is an additional object of the present invention to reduce the cost of re-using such container/dispensers by eliminating the costly inspection of the glass containment structure.

It is another object of the present invention to provide a dispenser that can dispense either vapor, if one valve set is used or liquid, if another valve set is used.

It is another object of the invention to provide a container/dispenser, the design of which permits the size of the container/dispenser to be significantly increased without sacrificing structural integrity, thereby providing a distinct advantage over prior art glass container/dispensers.

SUMMARY OF THE INVENTION

In one embodiment, the container/dispenser for an ultra high purity chemical includes a thin walled inner container made of TEFLON polymer or fluorocarbon material. The thin walled inner container is closed at the top by an inner container lid. An outer container surrounds the inner container and comprises a metal outer wall that is interiorly covered with a layer of TEFLON polymer or fluorocarbon material. The outer container is closed at the top by an outer container lid. The inner container is separated from the outer container by a plurality of spacers that space the side and bottom walls of the inner thin walled container away from the interior surface of the outer container. An inert gas is disposed in the interspace between the inner and outer container and a set of valves are mounted on the inner and outer container lids. In a vapor dispensing mode, one valve allows an inert gas to be bubbled through the ultra high purity chemical while another valve dispenses the "bubbled" chemical. In a liquid dispensing mode, another valve, coupled to a tube leading to the bottom of the inner container, permits withdrawal of high purity liquid chemical. Third and fourth valves permit injection and extraction of the inert gas from the interspace between the inner and outer containers The method of storing and dispensing includes the steps of containing the ultra high purity chemical in a thin walled TEFLON polymer inner container, surrounding the entirety of the inner container with an inert gas, providing an outer container and enclosing the inner gas and the surrounding inert gas with the outer container.

BRIEF DESCRIPTION OF THE DRAWINGS

Further objects and advantages of the present invention can be found in the detailed description of the preferred embodiments when taken in conjunction with the accompanying drawings in which.

DETAILED DESCRIPTION OF THE PREFERRED EMBODIMENTS

The present invention relates to a container/dispenser for ultra high purity chemicals and also a method of storing and dispensing those chemicals.

Figure 1:
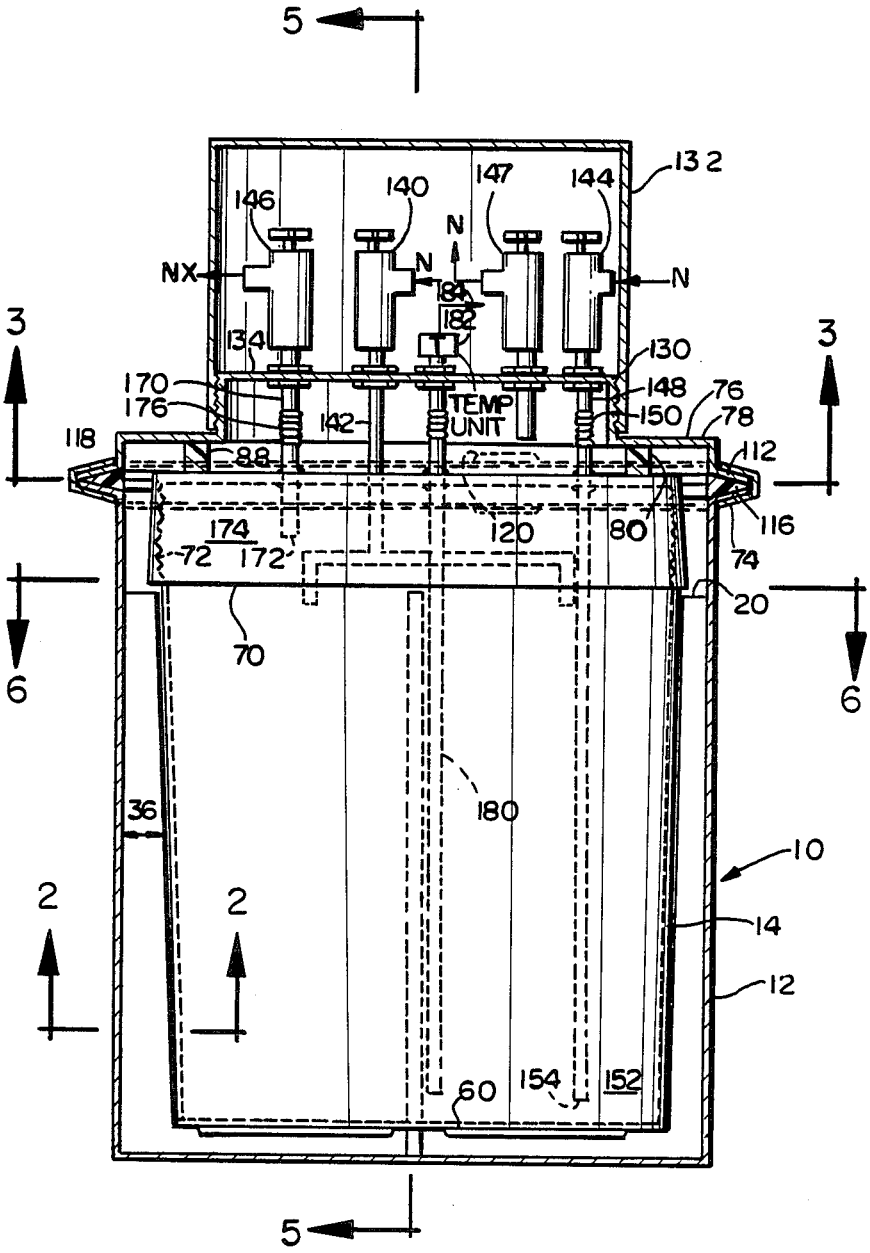
FIG. 1 shows a cross-sectional, diagrammatic view of the container/dispenser in accordance with the principles of the present invention.
Figure 5:
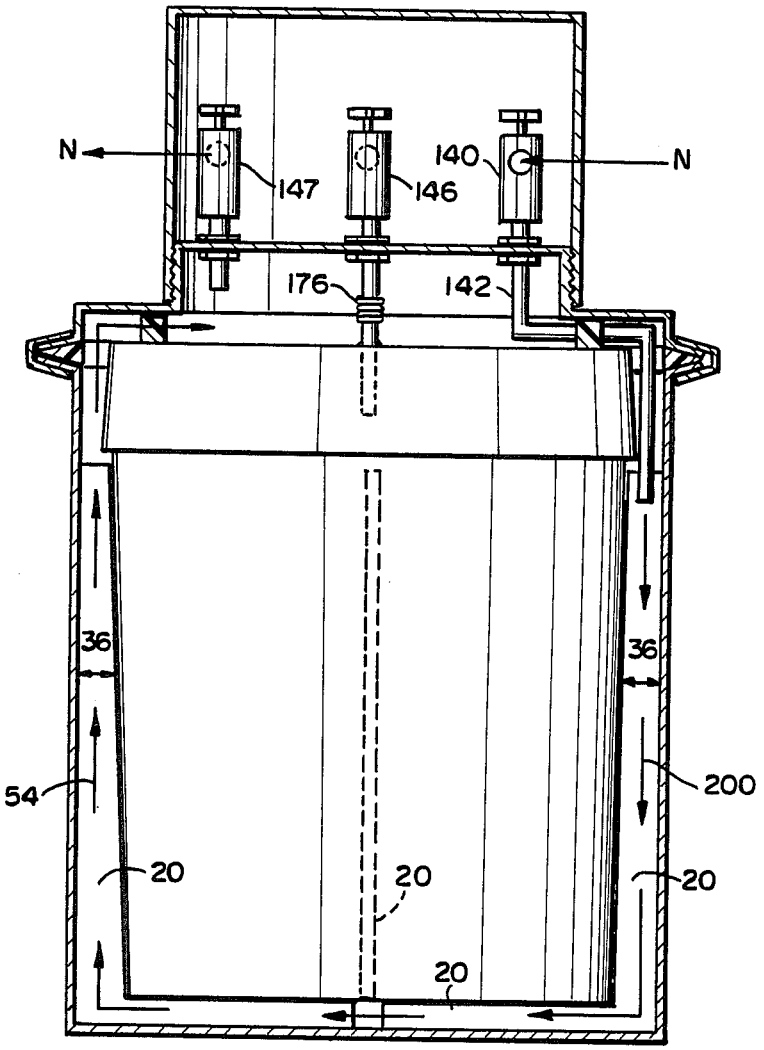
FIG. 5 diagrammatically illustrates the general flow of the gas as directed by the spacer assembly between the inner container and the outer container, from the perspective of section line 5'-5" in FIG. 1.
Figure 2:
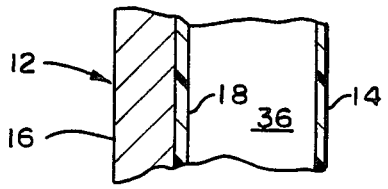
FIG. 2 shows a partial, cross-sectional view of a wall section of the container/dispenser from the perspective of section lines 2'-2" in FIG. 1.
Figure 6:
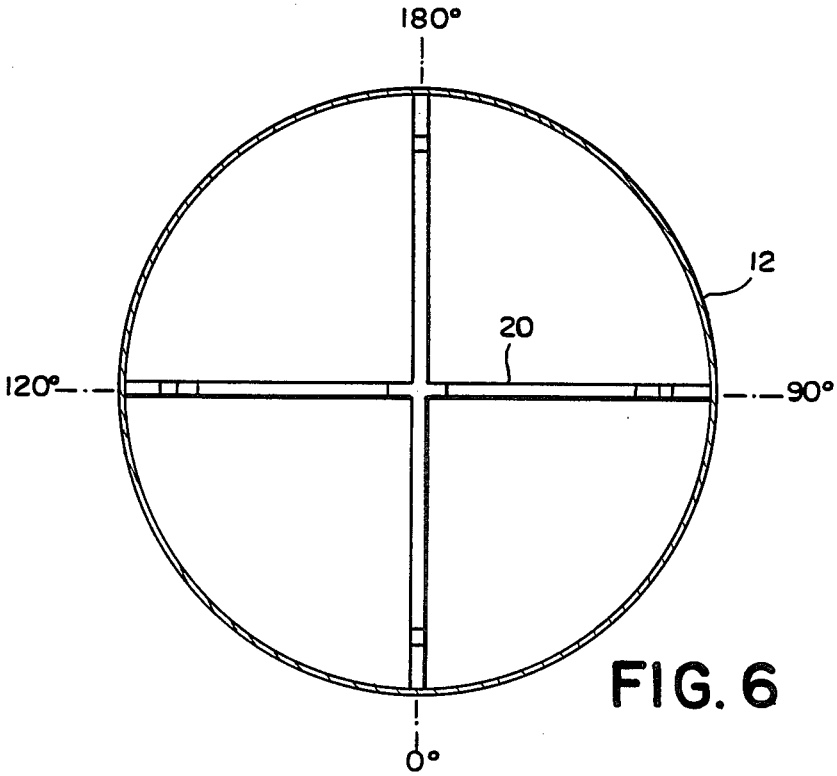
FIG. 6 illustrates a cross-sectional, axial view of the container dispenser without inner container 14 from the perspective of section lines 6'-6" in FIG. 1.

FIG. 1 illustrates a cross-sectional, diagrammatic view of container/dispenser 10. Container 10 includes a generally thick walled outer containment structure 12 and a generally thin walled inner container 14. The inner container may be a sleeve. As shown in FIG. 2, outer container 12 is a composite structure having a metal outer wall 16 that is interiorly coated or lined with a layer of perfluoroethylene, sold under the trademark TEFLON, or other polymeric material (such as fluorocarbon) 18. Inner container 14 is a generally thin wall of TEFLON polymer or such other material as compared with the liner or coating of TEFLON polymer 18 on the outer containment structure 12. Inner container 14 is spaced from outer container 12 by a spacer assembly 20. This spacer assembly supports inner container 14 as well as provide an interspace 36 between the inner and outer containers. This spacer assembly is TEFLON polymer or other polymeric material, such as fluorocarbon, and is designed to direct a flow of gas through interspace 36. FIG. 5 shows spacer assembly 20 and diagrammatically illustrates the flow of the gas. FIG. 6 also shows space assembly 20 without the inner container and its spatial relationship to outer container 12. Spacer assembly 20 preserves the isolation of outer container 12 from inner container 14 while providing a secure housing for inner container 14 and a directing mechanism for the inert gas. In a preferred embodiment, metal outer wall 16 is approximately 15 gauge stainless steel coated with a 20 mil thickness of TEFLON polymer layer 18. The spacer assembly is one-eighth inch thick and made of TEFLON polymer.

The top of inner container 14 is closed by an inner container lid 70 that is threadably attached and sealed to inner container 14 by interlocking threads at annular region 72.

Figure 4:
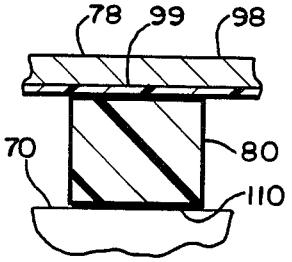
FIG. 4 illustrates a partial, cross-sectional view of one of the gas directing spacers from the perspective of section line 4'-4" in FIG. 3.
Figure 3:
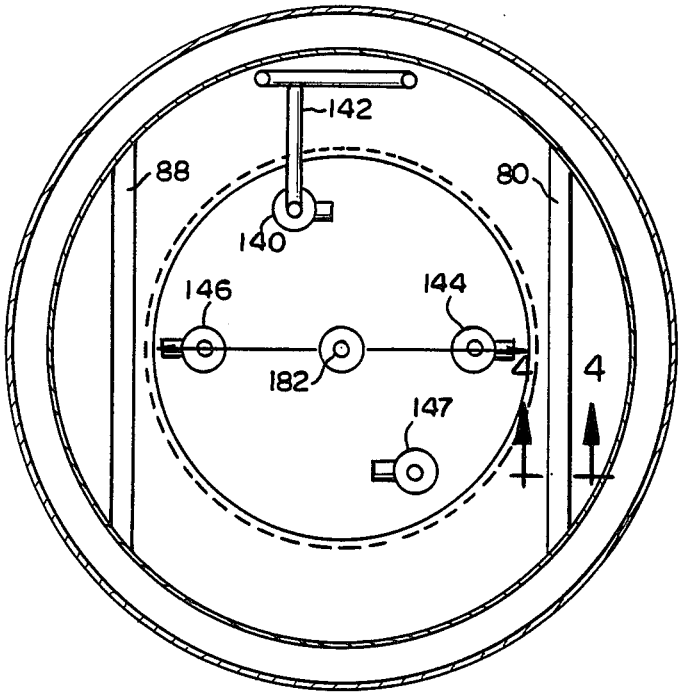
FIG. 3 illustrates a cross-sectional, axial end view of the container/dispenser from the perspective of section lines 3'-3" in FIG. 1.

The outer container is closed by an outer container lid 76 constructed in the same manner as outer container 12, that is, a metal outer wall that is internally covered or lined with TEFLON polymer or other polymeric material. Outer container lid 76 includes a radially inward protruding shoulder 78. Depending from annular shoulder 78 are spacers 80 and 88. See FIGS. 1 and 3. These spacers serve to hold inner container 14 tightly in place when lid 76 is connected to outer container 12. Annular shoulder 78 includes a metal outer wall 98 (see FIG. 4) and a relatively thick inner TEFLON polymer coating 99. Bottom surface 110 of spacer 80 is in close proximity to inner container lid 70.

Near the top of outer container 12 (FIG. 1), a circumferential flange 7 generally radially extends outward from the side wall of the container.

Outer container lid 76 includes a generally radially extending flange 112. Flange 112 of lid 76 is angled downward toward flange 74 of outer container 12 which is angled upward. A TEFLON gasket 116 is seated in the space between the upper and lower flanges that has a cross-sectional, conical shape. The gasket annularly seals outer lid 76 to outer container 12. The outer lid is clamped to the outer container via a clamp ring 118 that circumferentially encloses both flanges and is in turn circumferentially closed by a known mechanism diagrammatically shown as locking mechanism 120.

The top spacers, e.g., spacers 80 and 88 and the bottom section of spacer assembly 20, respectively, maintain the vertical positioning of inner container 14 while the side sections of spacer assembly 20 maintain the horizontal positioning of the inner container vis-a-vis the outer container.

Outer container lid 76 includes axially extending portion 130 which has, on its exterior, an interlocking thread section that matches the thread section on transportation cap 132. Transportation cap 132 is also a composite structure similar to outer container 12. Outer container lid 76 includes container top end wall 134 that closes the entire container. Therefore, inner container 14 is completely enclosed and spaced apart from outer container 12. Similarly, inner container lid 70 is a closed and spaced apart from outer container lid 76. Therefore, interspace 36 completely isolates inner container 14 from outer container 12 and the associated lids.

In this embodiment, four valves are shown mounted to end plate or wall 134 of outer container lid 76. Valve 140 permits the injection of an inert gas, that is, in one embodiment dry or water free nitrogen gas, into interspace 36. Another valve 147 permits the flow of heated inert gas, previously injected through valve 140, to be removed from the interspace during the dispensing operation. All the valves are mounted on end plate 134 by mechanical bulk head seals. With respect to valve 140, a valve stem assembly 142 only extends through the plane of end plate 134 and not through inner container lid 70 (see FIG. 3). Valves 144 and 146 extend through both end plate 134 and inner container lid 70. Valve stem 148 is sealed to end plate 134, has a flexible tube section 150, is sealed to inner lid 70, and extends into a bottom region 152 in the interior of inner container 14. Therefore, terminal end 154 of valve stem 148 is near bottom wall 60. Valve 144 is the input or fill-in sparger tube for the bubbler container 10. Valve stem 142 and stem 148 are teflon tubes. As diagrammatically shown, all the valve stems have flexible tube sections.

Valve 146 is the exit valve that dispenses the ultra high purity chemical vapor in the vapor dispensing mode and is the input valve for injecting inert gas into the container which forces liquid out of valve 144 during the liquid dispensing mode. Valve 146 includes valve stem 170 that extends through end plate 134 and inner lid 70. Terminal end 172 is in the upper region 174 of the interior of inner container 14. Valve stem 170 also includes flexible tube portion 176. Again, valve stem 170 is a teflon tube.

As described in U.S. Pat. No. 4,140,735 to Schumacher, it is typical to bubble the ultra high purity chemical from the dispenser. The pure chemical is normally maintained in a liquid phase that is a function of the pressure and temperature of the chemical. Therefore, to convert the chemical from the liquid phase into a gaseous phase, the temperature and pressure of the chemical in inner container 14 must be monitored and changed. A thermal well 180 extends into the bottom region 152 of inner container 14. Thermal well tube 180 extends through inner container lid 70 and end plate 134. A temperature sensor 182 is diagrammatically shown at the top of thermal well 180. Of course, temperature sensor 182 may have a probe extending throughout thermal well tube 180 in order to determine the temperature of the chemical. The output of temperature sensor 182 is applied to a temperature unit via, for example, electrical connection 184.

The TEFLON polymer walls could be any type of chemical resistant fluorocarbon material. Contrary to the study done by J. C. Schumacher Company discussed herein earlier, the double wall of TEFLON polymer with an interspace filled with an inert gas has proven to effectively block the diffusion of minute amounts of vapor and gasses or leaching of contaminants from the stainless steel outer metal wall or the environment. Therefore, migration of metal ions through the walls of the inner container are blocked by the double wall of TEFLON polymer and the interspace filed with inert gas. The spacer assembly directs the inert gas to change the phase of the contained chemical as well as substantially eliminate movement and vibration of the inner container within the bubbler apparatus. Outer cap 132 is threaded onto radial extension threaded region 130 of outer container lid 76 in order to protect valves 140, 144, 146 and 147.

In order to dispense the ultra high purity chemical vapor from the interior of inner container 14, heated nitrogen gas is injected into interspace 36 via valve 140. The gas flows about the interspace as shown by arrow 200 in FIG. 5. The gas flows about the side walls of inner container 14 and is directed by spacer assembly as shown by arrow 54 in FIG. 5. By using heated inner gas, the temperature of the high purity chemical is raised and is sensed by temperature sensor 182. At an appropriate time, a carrier gas such as nitrogen is introduced into valve 144 and the carrier gas is bubbled through the high purity chemical. The carrier inert gas then promotes the vaporization of the high purity liquid and both ar dispensed from the container via exit valve 146. The gas is dispensed at a rate equal to the flow rate of the gas injected into the inner container.

In order to dispense high purity liquid chemical, the roles of valves 172 and 144 are reversed. Inert gas under pressure is injected into inner container 14 via valve 146. The pressure, acting on the top of the liquid, forces the liquid out of valve 144 due to stem assembly 148 having a terminal end 154 near the bottom of the liquid. Hence, the present dispensing unit is capable of dispensing either vapor phase chemical or liquid phase chemical, therefore reducing the possibility of contamination of the chemical by eliminating an intermediate step of changing the phase, i.e., from vapor to liquid or vice-versa, of the high purity chemical.

Claims appended hereto are meant to cover modifications and changes within the scope and spirit of the present invention. As used in the claims, the term "fluorocarbon polymer" refers to a perfluoroethylene, TEFLON polymer, other fluorocarbon materials or similar polymeric material.

What is claimed is:

1. A reusable container dispenser for an ultra high purity chemical comprising:

a thin walled inner container having side and bottom walls made of a fluorocarbon polymer material and closed at the top by an inner container lid;

an outer container surrounding said inner container and having metal outer walls that are interiorly covered with a fluorocarbon polymer material, said outer container closed at the top by an outer container lid;

means for spacing said inner container away from said outer container thereby defining a completely surrounding interspace therebetween;

an inert gas disposed in said interspace; and means for filling and dispensing said ultra high purity chemical into and from said inner container, said means for filling and dispensing passing through said inner container lid and said outer container lid.

2. The container as claimed in claim 1 wherein said inert gas is dry nitrogen.

3. The container as claimed in claim 1 wherein said fluorocarbon polymer material covering said metal outer walls is a lining of fluorocarbon polymer material.

4. The container as claimed in claim 1 including valve means for injecting and dispensing said inert gas from said interspace.

5. The container as claimed in claim 1 wherein said means for spacing is a spacer assembly made of fluorocarbon polymer material disposed in said interspace and spacing said inner container side and bottom walls away from said outer container.

6. The container as claimed in claim 5 wherein said means for spacing includes a plurality of spacers made of fluorocarbon polymer material and spacing said inner and outer lids apart.

7. The container as claimed in claim 5 wherein said spacer assembly includes a plurality of side spacers and bottom spacers for positioning said inner container within said outer container.

8. The container as claimed in claim 7 wherein said spacer assembly provide means for circulating said inert gas in said interspace.

9. The container as claimed in claim 1 wherein said means for filling and dispensing includes a pair of valves, one valve having a short stem extending into an upper region of said inner container and the other valve having a long stem extending into a lower region of said inner container.

10. A container for an ultra high purity chemical comprising:

an inner container having thin fluorocarbon polymer walls and an inner container lid;

an outer container made of metal with an inner covering of fluorocarbon polymer, the outer container enclosing and spaced apart from said inner container to form an interspace about the entirety of said inner container; and an inert gas disposed in said interspace.

11. A method storing and dispensing an ultra high purity chemical comprising the steps of:

containing the ultra high purity chemical in a thin walled fluorocarbon polymer inner container topped with an inner container lid;

surrounding the entirety of said inner container with an inert gas;

providing an outer container having metallic walls interiorly covered with a fluorocarbon polymer material;

enclosing said inner container and the surrounding inert gas with said outer container and spacing said outer and inner containers apart; and, dispensing said ultra high purity chemical through a port in the inner container lid and a port in said outer container.

12. A method of storing and dispensing as claimed in claim 11 including the steps of injecting said inert gas into the space between said inner and outer containers and circulating said inert gas.

13. A method of storing and dispensing as claimed in claim 12 wherein the step of injecting uses heated inert gas during a dispensing of said high purity chemical.

14. A method of storing and dispensing as claimed in claim 11 including the step of dispensing ultra high purity chemical vapor by bubbling said inert gas therethrough.

15. A method of storing and dispensing as claimed in claim 11 including the step of dispensing ultra high purity chemical liquid by injecting inert ga under pressure into said inner container and withdrawing said ultra high purity chemical liquid from a bottom region of said inner container.

16. A method of containing an ultra high purity chemical comprising the steps of:

isolating said ultra high purity chemical from the environment by defining a fixed, enclosed space for the chemical with a wall of fluorocarbon polymer, substantially completely surrounding the fluorocarbon polymer wall with an inert gaseous barrier, and providing spaced away from said thin fluorocarbon polymer wall and capturing said gaseous barrier, a metal walled outer container interiorly covered with fluorocarbon polymer.

17. A method as claimed in claim 16 wherein said fluorocarbon polymer is a TEFLON polymer.

18. A container as claimed in claim 1 wherein said fluorocarbon polymer is a TEFLON polymer.

19. A method storing and dispensing an ultra high purity chemical comprising the steps of:

containing the ultra high purity chemical in a thin walled fluorocarbon polymer inner container topped with an inner container lid;

surrounding the entirety of said inner container with an inert gas;

providing an outer container having metallic walls interiorly covered with a fluorocarbon polymer material;

enclosing said inner container and the surrounding inert gas with said outer container and spacing said outer and inner containers apart;

dispensing said ultra high purity chemical through s port in the inner container lid and a port in said outer container; and, wherein heated inert gas in injected into and circulated within the space between said inner and outer containers during the dispensing of said high purity chemical.

20. A method as claimed in claim 19 wherein said fluorocarbon polymer is a TEFLON polymer.

* * * * *